US005413332A

United States Patent [19]

Montgomery

[11] Patent Number: 5,413,332

[45] Date of Patent: May 9, 1995

[54] EGGBALL

[75] Inventor: Lawrence M. Montgomery, Crystal Bay, Nev.

[73] Assignee: Amber Forrest, Inc., Incline Village, Calif.

[21] Appl. No.: 249,782

[22] Filed: May 26, 1994

[51] Int. Cl.[6] ..... A63B 37/02

[52] U.S. Cl. ..... 273/58 R; 273/58 E; 273/58 G; 273/58 J

[58] Field of Search ..... 273/58 R, 58 E, 58 G, 273/58 J, 58 K, 428, DIG. 10

[56] References Cited

U.S. PATENT DOCUMENTS

| | | | |
|---|---|---|---|
| D. 312,845 | 12/1990 | Matsuda | D21/104 |
| 890,920 | 6/1908 | Newbold | 273/58 K |
| 1,515,786 | 11/1924 | Munro | 273/58 EV X |
| 2,743,931 | 5/1956 | Pooley et al. | 273/58 J X |
| 3,195,267 | 7/1965 | Gehlen | 446/168 |
| 3,241,834 | 3/1966 | Stingley | 273/58 J |
| 3,660,930 | 5/1972 | Indjian | 446/297 |
| 3,712,627 | 1/1973 | Stroud | 273/128 A |
| 3,740,354 | 6/1973 | Dearmont | 273/58 J X |
| 3,885,795 | 5/1975 | Brewer | 273/176 |
| 3,930,650 | 1/1976 | Watson | 273/58 R X |
| 4,003,573 | 1/1977 | Craig, Jr. | 273/58 K |
| 4,067,569 | 1/1978 | Palumbo | 272/67 |
| 4,219,959 | 9/1980 | Fleischer | 446/486 |
| 4,698,043 | 10/1987 | May et al. | 446/273 |
| 4,930,777 | 6/1990 | Holenstein | 273/65 |
| 5,066,011 | 11/1991 | Dykstra et al. | 273/58 G |

FOREIGN PATENT DOCUMENTS

| | | | |
|---|---|---|---|
| 529271 | 11/1940 | United Kingdom | 273/58 G |

*Primary Examiner*—William H. Grieb
*Attorney, Agent, or Firm*—Jacques M. Dulin

[57] ABSTRACT

An egg-shaped elastomeric ball having a unique combination of texture, size, weight and composition features such that it can be thrown and bounced in a controllable manner, after the user develops a certain level of skill. Methods of manufacture and use in exercise, entertainment and sports are also described. The eggball has a major to minor axis ration on the order of 1.3 to 1.6, and more preferably in the range of 1.4 to 1.5, a major axis dimension in the range of about $2\frac{3}{4}$ to $3\frac{1}{4}''$, a mass on the order of from 60 to 120 grams, and preferably in the range of from 80 to 100 grams, and an exterior surface that while smooth, is textured and can be characterized as sanded or frosted. The durometer is between 30 and 40 and preferably from about 33 to 37. In the preferred embodiment, the surface texture is sanded, so that the exterior of a transparent composition has a translucent frosted look. For a novelty item the surface may be left smooth, shiny and generally transparent, and may have objects embedded therein. In an important embodiment, a light and battery can be embedded in the center of the eggball so that when the ball strikes a surface, or rotates end-over-end, the light goes on to permit play at night. Similarly a sound device, such as a whistle can be associated with the ball.

17 Claims, 3 Drawing Sheets

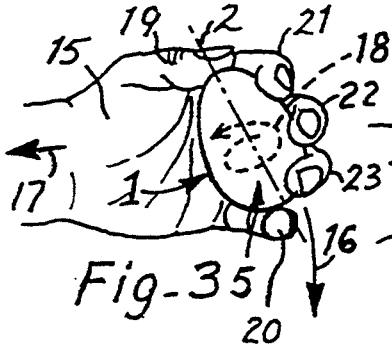
Fig-3
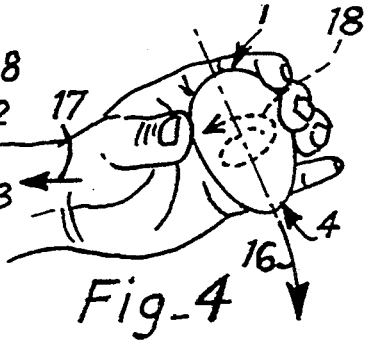
Fig-4
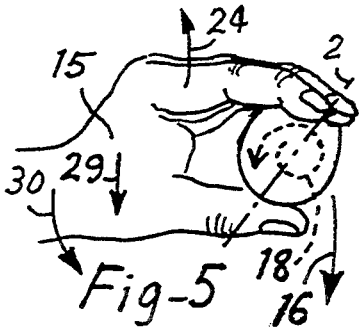
Fig-5
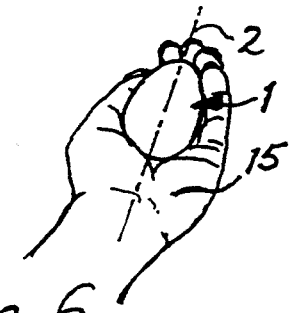
Fig 6
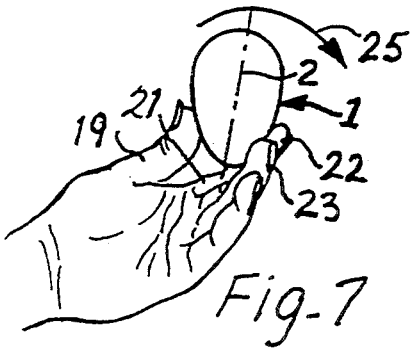
Fig-7
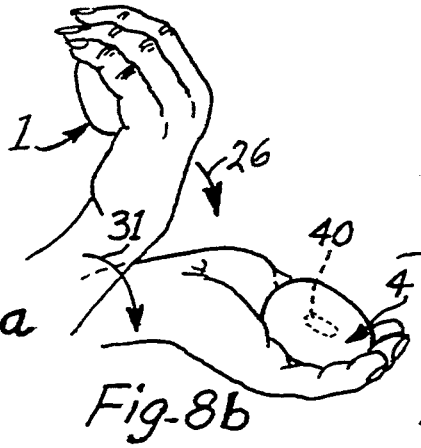
Fig-8a
Fig-8b
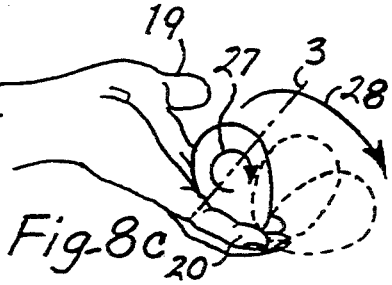
Fig-8c

EGGBALL

FIELD

This invention relates to exercise and entertainment devices, and more particularly to an amusement device comprising a special ball generally of egg-shaped configuration having a unique combination of texture, size, weight and composition features such that it can be thrown and bounced in a controllable manner, after the user develops a certain level of skill. Methods of use and manufacture are also described.

BACKGROUND

Balls, of which there are a wide variety, are a classic play toy which in many of its variations are used in athletics. Most balls are spherical so that the ball can be controlled and the bounce or rebound can be predicted. To Applicant's knowledge, while small 1–2" oval-shaped elastomeric balls are available, there are no properly-sized exercise or athletic balls that are egg-shaped due to the user's inability to control the ball and/or predict its rebound.

A number of toys have been proposed using egg-shaped balls, among them, Gehlen U.S. Pat. No. 3,195,267, which is directed to a V-shaped trough having legs at one end to form an incline down which is rolled an egg or "synthetic", non-bounceable egg. The synthetic egg is a shell containing heavy grease and having a smaller round ball or heavy weight embedded in the grease to provide a center of gravity.

Stroud U.S. Pat. No. 3,712,627 shows an egg-shaped elastomeric ball having a hollow space at the large end. This ball is specifically engineered to have a center of gravity space between the center of the major axis and the longitudinal midpoint. One end is hemispherical and the other parabolic with essentially no transition zone therebetween.

Craig U.S. Pat. No. 4,003,573 shows an irregularly shaped ball, generally oval in shape, having both ridges and grooves between the ridges to provide erratic and unpredictable bounces.

Fleischer U.S. Pat. No. 4,219,959 is a toy egg composed of two intertwined helically cut shells of plastic. Brewer U.S. Pat. No. 3,885,795 is directed to an egg-shaped golf ball with a dimpled surface for a miniature golf game.

None of these balls have been taught to be thrown except for Craig U.S. Pat. No. 4,003,573 and Fleischer U.S. Pat. No. 4,219,959. The former clearly indicates that the ball is not controllable because of the ridges and grooves. It derives its amusement effect from the unpredictability of the rebound.

All of these balls eliminate the skill factor, which is one of the greatest satisfactions in amusement, athletic and entertainment devices. Accordingly, there is a need for an improved ball which due to its non-round shape provides a high degree of control challenge.

THE INVENTION

OBJECTS

It is among the objects of this invention to provide a generally egg-shaped ball which due to its surface texture, size, weight, configuration and composition can be controlled and function as an amusement, entertainment and athletic ball.

It is another object of this invention to provide an egg-shaped ball and a method for throwing it so that its rebound can be controlled and predicted, thereby presenting a challenge to the user, who through acquired technique can learn to use and control the ball for amusement, exercise or athletic purposes.

It is another object of this invention to provide a novelty device in the form of an egg-shaped ball, the composition of which can be controlled during manufacturing to provide an extremely attractive ball having aesthetic qualities ranging from transparent, to translucent, to semi-transparent/semi-translucent/opaque, to frosted translucent, or to opaque in a wide variety of colors, patterns, swirls and mosaics, or into which can be embedded a variety of objects which can be seen through the transparent or translucent composition.

Still other objects will be evident from the specification, claims and drawings of this application.

DRAWINGS

The invention is illustrated in references to the drawings in which:

FIG. 3 is a side view of the left hand of a player showing how the eggball is rotated and thrown downwardly in a beginners throw;

FIG. 4 is a side view showing the eggball grasped with the fingers and thumb of the left hand with the small end downwardly for an advanced level of play;

FIG. 5 is a side view showing the eggball oriented with its major axis in a generally horizontal position and grasped by the thumb on the bottom and the fingers on the top to impart a spin so the ball strikes on its side for an intermediate level of play;

FIG. 6 shows in perspective how to hold the eggball palm-up with the large end of the ball facing the user for throwing against the ground;

FIG. 7 shows in side view the ball just leaving the fingers for a throw toward the ground;

Figure 9B:
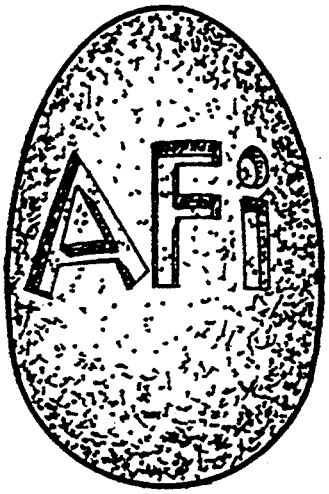
Figure 9A:
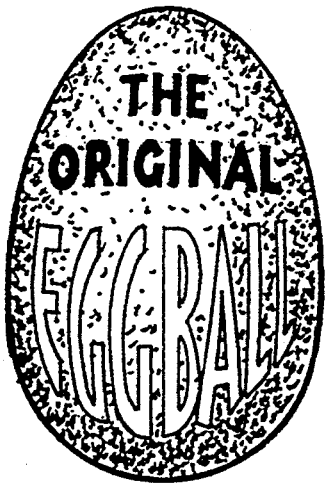
Figure 9C:
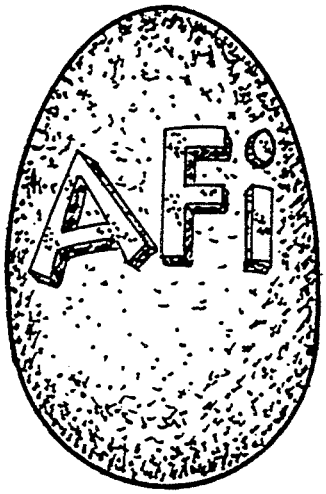
Figure 9D:
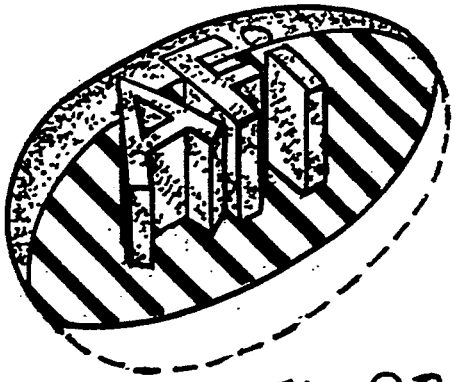
Figure 10:
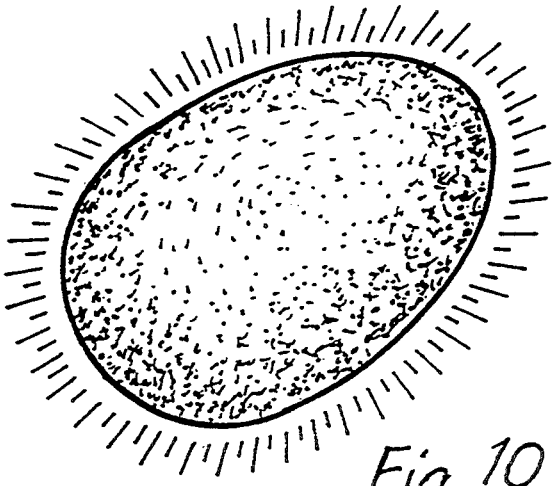

FIG. 8*a* and 8*b* and 8*c* are a series of side views showing the wrist motion for a typical ground throw;

FIGS. 9A–9D illustrate embodiments of the egg ball of this invention with a logo or design molded into or applied therein; and FIG. 10 illustrates an embodiment of the invention in which the plastic composition of the ball of this invention includes an additive with the property of glowing in the dark.

SUMMARY

The invention comprises a generally egg-shaped ball, called herein an "eggball" as a descriptive term, having a special configuration, weight, dimensions, surface textures and compositions useful for novelty, entertainment, exercise and athletic purposes and events. More specifically, the eggball of this invention has a major to minor axis ratio on the order of 1.3 to 1.6 and more preferably in the range of 1.4 to 1.5, has a major axis dimension in the range of about to $2\frac{1}{2}$" to $3\frac{1}{2}$, and preferably in the range of from $2\frac{3}{4}$ to $3\frac{1}{4}$, has a mass on the order of from 60 to 120 grams, and preferably in the range of from 80 to 100 grams, and has an exterior surface that while smooth, is textured and can be characterized as medium to fully sanded or frosted. The durometer is between 30 and 40 and preferably from about 33 to 37. In the preferred embodiment, the surface texture for the exercise, entertainment and sport ball is sanded, so that the exterior of a transparent composition eggball has a translucent frosted look. For a novelty item which is generally transparent, and may have objects therein, the surface may be left smooth and shiny.

The rebound of a thrown eggball can be predicted and controlled by an appropriate throw. While a wide variety of spins and motions can be imparted, which will be evident to the user after practice, several types of throwing motion are of particular interest. Generally, the ball may be spun on its major axis, either large end down or small end down, so as to impact on that chosen end. The rebound characteristics differ, of course, in that the larger end provides a larger compression surface, and exhibits a different characteristic of rebound than striking on the small end. In addition, the ball can be held with the major axis oriented generally horizontally. In this orientation there are two major alternative positions: First, the major axis is oriented transverse to the players body, and second, the major axis is oriented in the direction the player's body is facing. In the first instance, imparting a spin around the major axis permits the ball to strike on its side in the relatively flat transition zone between the large end, which is generally hemispherical, and the small end, which is generally parabolic, in cross-section or oval. For a long distance throw against the ground, the ball can be thrown underhand or overhand. For an underhand throw, (i.e., a palm-up throw), long bounces can be obtained with alternating bounces on the large end and the small end by holding the ball in the palm of the hand and throwing it with a quick downward rotation of the wrist so that the ball is tipped end over end off the fingertips toward the ground. The ball can be thrown overhand to the ground for a high, long bounce, and is caught when descending in a game call "popfly".

In one particularly interesting and challenging game, the ball can be used as a handball or paddleball in a squash or handball court, or on a pelote court. While the hands may be used, a wide variety of conventional implements such as handball gloves, squash rackets, or pelote catchers can be used. After some practice, a player can control the direction of throw and the end or portion of the ball which impacts, thus providing unexpected bounces. This can be compounded by a variety of axial or off axial spins utilizing either the major or minor axis as a frame of reference. As compared, however, to ordinary handball, the use of the eggball is an advanced level of play.

In actual play experiments, children become extremely intrigued and excited when they are able to master even the easiest of throws. A first attempt to throw the ball without any thought as to how it can be controlled results in a random bounce. However, once taught a spin throw, children are delighted to master and predict the ball's rebound. The smoothly textured surface permits a good grip and the ability to impart a controlling spin to the ball, while not detracting from the esthetics of the multiple colors that can be imparted to the ball by appropriate selection of the elastomer compounds. In an important embodiment, logos of various sponsors, such as fast food franchises, sporting goods manufacturers or exercise equipment manufacturers can be molded into or applied to the ball.

The eggballs of this invention can be made by many conventional molding processes, followed by sanding the balls, i.e., by tumbling or on a rotary sanding table. In the preferred embodiment, a multiple-layer stack of different colored, uncured, polybutadiene sheets are laid out, diced and placed in or extruded into a mold under heat and pressure and partially cured. The partially cured balls are then removed from the molds. At that point they have enough integrity to be handled. However, their durometer is much too soft to provide the necessary rebound characteristics. The balls are then subsequently cured to the desired durometer, for example for 15–60 minutes at a temperature of from 150°–200° F., in a variety of modes such as in-the-mold curing, oven (air) curing, microwave, or oil bath curing. The preferred method is to immerse the balls in silicone oil and cure them for about 30 minutes at around 175° F. The resulting cured eggballs may then be sanded to impart the exterior texture or, if desired, they may be left totally transparent and smooth, removing only flashing to produce the final product.

By this process, a wide variety of extremely colorful eggballs can be produced which range from totally transparent, to translucent, to opaque, and with varying zones of translucence and transparency along with opaque areas. The result is an extremely attractive novelty ball, and play or athletic device. In one embodiment, the ball can be opaque in any color, e.g. a uniform white or cream, and overprinted with patterns, text, trademarks and the like.

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

Figure 1:
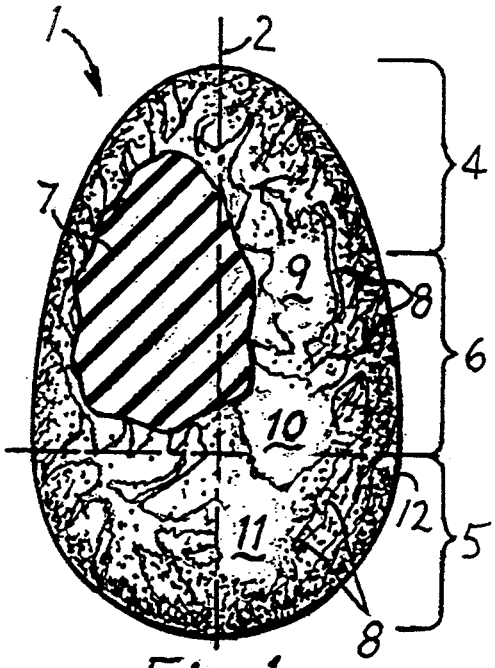
FIG. 1 is a side elevation of the eggball of this invention, with a portion broken away to show the interior compositional nature thereof.

FIG. 1 shows in elevation the eggball of this invention 1 having a major axis 2 in the range from 1.4 to 1.5 times longer than minor axis 3. The eggball, which is preferably made of a polybutadiene compound, has a first, small end 4 which in cross section is generally parabolic, joined to a second generally hemispherical end 5 by a smoothly tapering flatter intermediate section 6. The intermediate section generally has an axial length as long as each of the end sections.

A section has been broken away to show the solid interior for good rebound characteristics and longer life than hollow balls. The lines 8 delineate the edges of zones 9, 10 and 11 of different colored elastomer, so that the eggball has a highly colored mosaic appearance. In this example the ball has a major axis length of $2\frac{7}{8}'' \pm 1/16''$, a minor axis of $2'' \pm 1/16''$, and a weight of about 90 grams. The elastomer has a durometer value of about 35 for good rebound and durability.

The exterior surface 12 has a smooth "sanded" texture, which can be distinguished easily by sight and touch as "frosted". The surface texture permits excellent good gripping even with finger tips, and permits hand control of spin along the major or minor axis (or off axis if desired) when thrown. In cases where the elastomer is initially transparent, the surface sanding results in a translucent quality, which is especially attractive when light impinges on the eggball and for variations where the elastomer has light swirls of color or is uniformly and lightly colored. The result evokes swirls of colored smoke or mist in frosted glass.

The distinctly delineated zones 9, 10, 11 are formed by individually separately colored pieces of elastomer placed in the mold for bonding under heat and pressure. In contrast the swirls or mist streaks are formed by stirring-in color in transparent polymer but leaving it short of thorough and uniform mixing, and then introducing the thus-marbleized uncured polymer into the mold for at least partial curing. Rather than post curing sanding, the mold can be sandblasted to provide an as-molded frosted texture.

Figure 2:
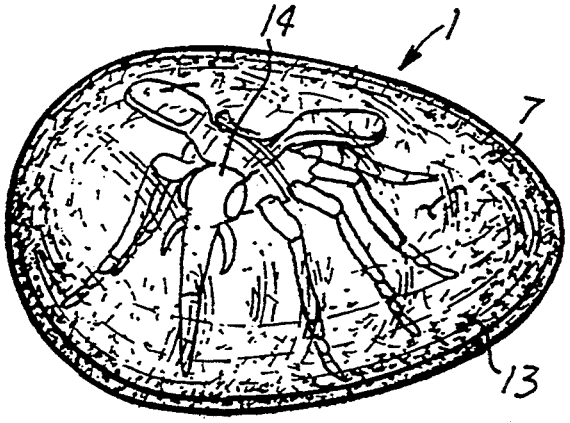
FIG. 2 shows the eggball of this invention in still another embodiment in which the composition of the elastomer is highly transparent or translucent and contains embedded therein an insect as a combined novelty and amusement device.

FIG. 2 shows an alternative embodiment in which eggball 1 has a smooth glossy or shiny texture, resulting from a polished mold. In this case the eggball elastomer 7 is transparent, e.g an amber color, and has a plastic insert 14 embedded therein as a simulated prehistoric novelty item, i.e, an insect.

FIGS. 3–8*c* show various methods of play, exercise or athletic endeavor involving use of the ball. FIG. 3 shows eggball 1 being grasped in the left hand 15 of an adult with the large hemispherical section facing downwardly. The ball is thrown down, as illustrated by arrow 16 while at the same time the hand is drawn backward in the direction of arrow 17 to impart spin 18 around the major axis 2. Note that the eggball 1 is sized to fit comfortably between the thumb 19 and little finger 20. The frosted or sanded texture of the ball permits fingers 21, 22, 23 a gripping surface to impart the spin 18. FIG. 3 shows the basic or beginner throw.

FIG. 4 shows grasping the ball for an advanced throw with the small end 4 downwardly. The throw is similar to that of FIG. 3 but the ball is grasped between the thumb and one or more fingers along the side as shown. With the proper spin 18 the eggball can be controlled to rebound back to the thrower, or to or away from a teammate or other player.

Note that FIGS. 3 and 4 are alternate ways of throwing the ball, that is the ball can be thrown with the grasp of FIG. 4 with the narrow end 4 down, or conversely the FIG. 3 grasp can be used to throw the ball with the wide end 5 down.

FIG. 5 shows an intermediate throw with the major axis 2 being oriented generally horizontally and the ball thrown downwardly. To impart spin the hand is generally moved downwardly 29 while the wrist is dropped 30, and the fingers simultaneously peel backward off the top of the ball 24, to impart spin 18. By canting the major axis a few degrees from the horizontal the eggball can be made to bounce to the right or left of the thrower.

FIG. 6 shows a method of cradling the eggball in hand 15 preparatory to an end-over-end toss shown in FIG. 7 by arrow 25. Note in FIG. 7 the ball is last gripped by thumb 19 and fingers 21, (not seen) 22, 23 at release.

FIGS. 8*a, b, c* show an alternate end-over-end long distance throw in which the wrist is dropped first as shown by arrow 31, while the hand rotates as shown by arrow 26. This imparts forward momentum and spin on the minor axis 3, while the thumb 19 is held to the side (FIG. 8*c*). At the point of release the index finger, 21 (not seen) and little finger 20 guide the sides of the ball adjacent the parabolic end while spin 27 around minor axis 3 is imparted with the ball going end over end as shown by arrow 28. Long distance bounces can be imparted to the eggball in this manner.

It should be understood that various modifications within the scope of this invention can be made by one of ordinary skill in the art without departing from the spirit thereof. For example, as seen in FIG. 8*b*, a battery-powered flashing light 40 can be molded into the interior so that as the ball rotates end over end, or rebounds, the light flashes alternately on and off. Similarly, a sound device such as a whistle can be secured exteriorly, or embedded interiorly of the ball before molding with holes from the exterior to the whistle being provided to permit air flow to activate the whistle.

Alternately, the ball can be made in parts and glued together with a suitable adhesive or solvent glue. For example, a cavity can be provided in the center of a 2-part ball to receive a battery to power a light or sound-emitting device. The light or sound device and battery are assembled in the cavity and the ball halves glued together. One or more holes may be provided to the exterior in the case of the sound device to permit the sound to exit.

FIGS. 9A–9B illustrate the embodiment of the eggball in which a logo or design is:

a) applied to the eggball (FIG. 9A–printing); or
b) molded into the eggball (FIG. 9B recessed or embossed; FIG. 9C raised or cast; FIG. 9D embedded).

FIG. 10 shows an eggball wherein the elastomer includes at least one additive, which when exposed to light, permits it to glow in the dark thereafter.

I therefore wish my invention to be defined by the scope of the appended claims as broadly as the prior art will permit, and in view of the specification if need be.

I claim:

1. A ball for amusement exercise and athletic competition comprising in operative combination:

a) a solid body of generally egg shaped exterior configuration having a first major axis and a second minor axis;
b) the ratio of said major axis to said minor axis lying within the range of about 1.3 to about 1.6;
c) said ball has a first small end generally parabolic in cross section, a second, opposed, larger end of generally hemispherical configuration, and an intermediate zone having a smooth generally flattened curve so that said opposed end smoothly fair into said intermediate zone;
d) said ball is composed of an elastomer having a durometer in the range of from about 30 to about 40;
e) said ball has a length in the range of about 2½ to about 3½" along its major axis;
f) said ball has a mass in the range of from about 60 to 120 grams; and
g) said ball is of a size to fit comfortably in the human hand between the index and little fingers and which is controllable to impart spin along selective ones of said axes to control the rebound thereof.

2. An eggball as in claim 1 wherein:

a) the surface of said ball has a smooth, sanded-type texture to provide a finger-gripable surface.

3. An eggball as claim 1 wherein said elastomer is generally transparent and includes an object embedded centrally thereof.

4. An eggball as in claim 3 wherein said object is a plastic animal.

5. An eggball as in claim 4 wherein said animal is an insect and said elastomer is generally amber in color.

6. An eggball as in claim 1 wherein said eggball is composed of multi-colored elastomer pieces bonded together to form a unitary whole.

7. An eggball as in claim 7 wherein at least some of said elastomer pieces are generally transparent.

8. An eggball as in claim 1 wherein said elastomer has embedded therein different colored plastic material comprising a logo or design visible in the exterior surface of said eggball.

9. An eggball as in claim 1 wherein said elastomer is generally transparent and includes swirls of color on the interior thereof which are visible from the exterior.

10. An eggball as in claim 9 wherein:

a) the exterior surface is textured to provide a surface having the appearance of frosted glass.

11. As eggball as in claim 1 wherein at least some of said elastomer includes at least one additive, which when the ball is exposed to light, permits it to glow in the dark thereafter.

12. An eggball as in claim 1 which includes:

a) a battery powered light unit encapsulated centrally within said eggball, which unit has a first "off" mode when at least one of said major or minor axes are oriented in a first position, and a second "on" mode when said major and minor axes are oriented in a second position, so that said light can flash alternately on and off when said ball rotates around at least one of said axes.

13. An eggball as in claim 1 which includes:

a) a sound device secured in said ball having a vent to guide air to said device so that upon throwing said ball air activates said device to emit sound.

14. An eggball as in claim 1 wherein:

a) the length of said eggball along its major axis ranges from about $2\frac{7}{8}''$ to $3\frac{1}{8}''$;

b) the width of said along its minor axis ranges from $1\frac{7}{8}''$ to $2\frac{1}{8}''$;

c) the weight of said ball ranges from about 80–100 grams;

d) the durometer of said ball ranges from about 33 to about 37; and e) said surface texture is produced by post-curing sanding to provide a uniform, smooth matte finish.

15. A method of play with a ball comprising:

a) providing an eggball as in claim 1;

b) grasping said ball with at least one hand;

c) throwing said ball against a floor, the ground or a wall while imparting a spin around at least one of said axes to control and direct the rebound back to the person throwing the ball, or to or away from another player.

16. A method of play with a ball comprising:

a) providing an eggball as in claim 14;

b) grasping said ball with at least one hand;

c) throwing said ball against a floor, the ground or a wall while imparting a spin around at least one of said axes to control and direct the rebound back to the person throwing the ball, or to or away from another player.

17. An eggball as in claim 1 wherein said eggball has a logo or design molded into or applied to the elastomer.

* * * * *